US012613053B2

(12) United States Patent
Elshorbagy

(10) Patent No.: US 12,613,053 B2
(45) Date of Patent: Apr. 28, 2026

(54) DISTRIBUTED ZONE CONTROL SYSTEM

(71) Applicant: Hazem Elshorbagy, Houston, TX (US)

(72) Inventor: Hazem Elshorbagy, Houston, TX (US)

( * ) Notice: Subject to any disclaimer, the term of this patent is extended or adjusted under 35 U.S.C. 154(b) by 0 days.

(21) Appl. No.: 18/820,227

(22) Filed: Aug. 29, 2024

(65) Prior Publication Data

US 2024/0418393 A1 Dec. 19, 2024

Related U.S. Application Data

(63) Continuation of application No. 18/231,603, filed on Aug. 8, 2023.

(60) Provisional application No. 63/398,171, filed on Aug. 15, 2022.

(51) Int. Cl.

| | |
|---|---|
| ***F24F 11/76*** | (2018.01) |
| ***F24F 11/58*** | (2018.01) |
| ***F24F 13/10*** | (2006.01) |
| ***F24F 110/10*** | (2018.01) |
| ***F24F 110/40*** | (2018.01) |
| ***F24F 110/65*** | (2018.01) |
| ***F24F 120/10*** | (2018.01) |

(52) U.S. Cl.

CPC ..... *F24F 11/76* (2018.01); *F24F 11/58* (2018.01); *F24F 13/10* (2013.01); *F24F 2110/10* (2018.01); *F24F 2110/40* (2018.01); *F24F 2110/65* (2018.01); *F24F 2120/10* (2018.01)

(58) Field of Classification Search

CPC .. F24F 11/76; F24F 11/58; F24F 13/10; F24F 2110/10; F24F 2110/40; F24F 2110/65; F24F 2120/10

See application file for complete search history.

(56) References Cited

U.S. PATENT DOCUMENTS

| | | | | |
|---|---|---|---|---|
| 4,903,583 | A * | 2/1990 | Frazier | F24F 3/16 422/306 |
| 6,250,382 | B1 * | 6/2001 | Rayburn | F24F 11/62 165/251 |
| 8,550,370 | B2 * | 10/2013 | Barrett | F24F 11/62 62/77 |
| 10,371,399 | B1 * | 8/2019 | Rodriguez | F24F 3/0442 |
| 2014/0097266 | A1 * | 4/2014 | Habbel | B65D 83/262 239/69 |
| 2015/0285524 | A1 * | 10/2015 | Saunders | F24F 11/62 454/239 |
| 2015/0370927 | A1 * | 12/2015 | Flaherty | F24F 11/30 703/1 |
| 2020/0041162 | A1 * | 2/2020 | Conrad | F24F 13/30 |
| 2020/0141608 | A1 * | 5/2020 | Sinha | F24F 11/65 |

* cited by examiner

*Primary Examiner* — Charles R Kasenge

(74) *Attorney, Agent, or Firm* — Manuel de la Cerra

(57) ABSTRACT

A distributed zone control system having one or more vents with sensors and effectors is provided. The effectors operate in response to the sensors. In various embodiments, the effectors of one vent may operate in response to the sensors of another vent. In various instances, the distributed zone control system connects to an HVAC system and controls operation of the HVAC system. In this manner, temperatures may be detected by a vent and conditioned air from the HVAC system directed to appropriate zones to maintain desired conditions.

13 Claims, 7 Drawing Sheets

DISTRIBUTED ZONE CONTROL SYSTEM

CROSS-REFERENCE TO RELATED APPLICATION

This application is a continuation of U.S. patent application Ser. No. 18/231,603 entitled "DISTRIBUTED ZONE CONTROL SYSTEM" filed on Aug. 8, 2023, which is based upon and claims priority to U.S. Provisional Patent Application No. 63/398,171 entitled "DISTRIBUTED ZONE CONTROL SYSTEM" and filed on Aug. 15, 2022, the entire contents of which is incorporated herein by reference.

FIELD

The present invention relates to the field of home automation. More particularly, the present invention relates to home automation utilizing HVAC vents.

BACKGROUND

Homeowners frequently desire to enhance the automation of their homes. Often homes contain HVAC systems with legacy controls and/or that treat the entire home as a single zone. Moreover, existing construction homes often present automation challenges due to the difficulty in changing wiring. Furthermore, new construction homes often present automation challenges due to the wide array of options available and variations in individual home owner preferences. Thus, there is a need for an adaptable and flexible distributed smart home vent system that utilizes existing infrastructure in the home.

SUMMARY

A distributed zone control system comprising one or more vents. Such a vent may include a sensor and an effector. Also, one or more peripheral devices may be provided. Such components of the distributed zone control system may communicate via a vent communication channel and/or a peripheral communication channel. These components may be connected to a network, which may further comprise a controller. Also, the network may include a controller communication channel and/or HVAC system communication channel.

A distributed zone control system is for optimizing zone conditions. The system may include at least one vent, further including a sensor and an effector. The system may include a controller configured to receive data from the sensor and instruct an actuation of the effector in response to the data.

In various embodiments, the sensor is a temperature sensor. The effector may be a gate configured to regulate airflow through the vent. The data may correspond to a detected temperature being below a first threshold. The controller may close the gate to decrease airflow through the vent in response to the detected temperature being below the first threshold.

In various embodiments, the sensor is a temperature sensor. The effector may be a gate configured to regulate airflow through the vent. The data may correspond to a detected temperature being above a first threshold. In various embodiments, the controller closes the gate to decrease airflow through the vent in response to the detected temperature being above the first threshold.

The sensor may be a temperature sensor. The effector may be a gate configured to regulate airflow through the vent. The data may correspond to a detected temperature. The controller may actuate the gate in a first direction to decrease airflow through the vent in response to the detected temperature being outside the first threshold. The controller may actuate the gate in a second direction to increase airflow through the vent in response to the detected temperature being outside a second threshold.

In various embodiments, outside the first threshold includes the detected temperature being less than a first threshold temperature and outside the second threshold includes the detected temperature being greater than a second threshold temperature. The second threshold temperature may be greater than the first threshold temperature.

The sensor may be various types of sensors. For instance, the sensor may be at least one of a temperature sensor, a duct pressure sensor, a gas detection sensor, and an occupancy sensor. The effector may be a gate configured to regulate airflow through the vent. The data may correspond to the sensor detecting an event associated with a sensed variable sensed by the sensor being outside a desired range. The controller may close the gate to decrease airflow through the vent in response to the sensed variable sensed by the sensor being outside the desired range.

In various embodiments, the sensor is a periodic timer and the effector is an aroma dispenser. In various embodiments, the actuation of the effector includes to releasing an aromatic substance into the vent for distribution in a room by an air source connected to the vent at a periodic time indicated by the periodic timer. The at least one vent may include a first vent having the sensor and the effector and a second vent having a second effector. The controller may be configured to receive data from the sensor and instruct a further actuation of the second effector in response to the data. In various embodiments, the sensor and the effector are both connected to the controller, and the at least one vent includes a first vent having the sensor and the effector and a second vent having a second effector. The controller may be configured to receive data from the sensor and instruct a further actuation of the second effector in response to the data.

In various embodiments, the distributed zone control system for optimizing zone conditions is an HVAC control system for maintaining a desired temperature in multiple zones. The zones may be rooms. The vents may be HVAC duct outlet vents of an HVAC system. The vents may be connected to the controller via cabling that runs adjacent to ducts of the HVAC system. The controller may be integrated into a thermostat of the HVAC system. The vents may be connected to the controller via cabling that runs inside of ducts of the HVAC system.

A distributed zone control system is provided. The system may include a first HVAC vent connected to an HVAC cooling system and a second HVAC vent connected to the HVAC cooling system. The first HVAC vent may have a first sensor and a first effector. The second HVAC vent may have a second sensor and a second effector. There may be a controller connected to the first sensor, the first effector, the second sensor, and the second effector via a network.

In various embodiments, the network includes cabling running adjacent to ducts of the HVAC cooling system. The controller may be an HVAC thermostat. The controller may be a remotely disposed computer connected to the network via an internet connection. The controller may be a smartphone connected to a remotely disposed computer, and the remotely disposed computer may be a server connected to the network via an internet connection.

An HVAC vent for connection to a distributed zone control system of an HVAC cooling system is provided. The HVAC vent may include a vent configured to conduct conditioned air from an HVAC duct to a context environment, a sensor including a temperature sensor on the HVAC vent to detect a temperature of at least one of the conditioned air and the context environment, and an effector including a gate on the HVAC vent to regulate a volume of conditioned air conducted from the HVAC duct by the vent. The effector moves to permit a greater or lesser volume of conditioned air conducted from the HVAC duct by the vent in response to an indication by the temperature sensor of the temperature being above or not above a desired set-point temperature, respectively. In various embodiments, the effector moves in response to an instruction from a controller attached to the HVAC vent and connected to the sensor.

BRIEF DESCRIPTION OF FIGURES

A more complete understanding of the present invention may be derived by referring to the detailed description and claims when considered in connection with the Figures, where like reference numbers refer to similar elements throughout the Figures, and:

FIG. 5 illustrates an example embodiment of operation of the ZMS, EMS, HIMS, and UI;

FIG. 6 illustrates an example embodiment of operation of the zone monitoring system, in accordance with various embodiments;

FIG. 7 also illustrates an example embodiment of the operation of the zone monitoring system, in accordance with various embodiments;

FIG. 8 also illustrates an example embodiment of the operation of the zone monitoring system, in accordance with various embodiments;

FIG. 9 also illustrates an example embodiment of the operation of the EMS, in accordance with various embodiments;

FIG. 10 illustrates an example embodiment of the operation of the HIMS, in accordance with various embodiments; and FIG. 11 illustrates an example embodiment of the operation of the UI, in accordance with various embodiments.

DETAILED DESCRIPTION

The following description is of various exemplary embodiments only, and is not intended to limit the scope, applicability, or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

The disclosure relates to electronic products and software applications associated with smart homes. A distributed zone control system of the described devices provides users a unique way to monitor and control home variables. In various embodiments, disclosed is a system and method for integrating several features of standalone smart home devices via an integrated solution. For example, in various embodiments, the disclosure may include hardware and software technologies to monitor various smart home variables via a computerized display and/or via a handheld device. Moreover, home equipment and devices may be controlled via a handheld device, computer, or via touchless voice commands in the working vicinity of the described solution. Lastly, the disclosure herein provides the owner/user with an option to purchase and install devices having a single- or a multi-functioning operational mode performing several functions of this system.

Figure 1:
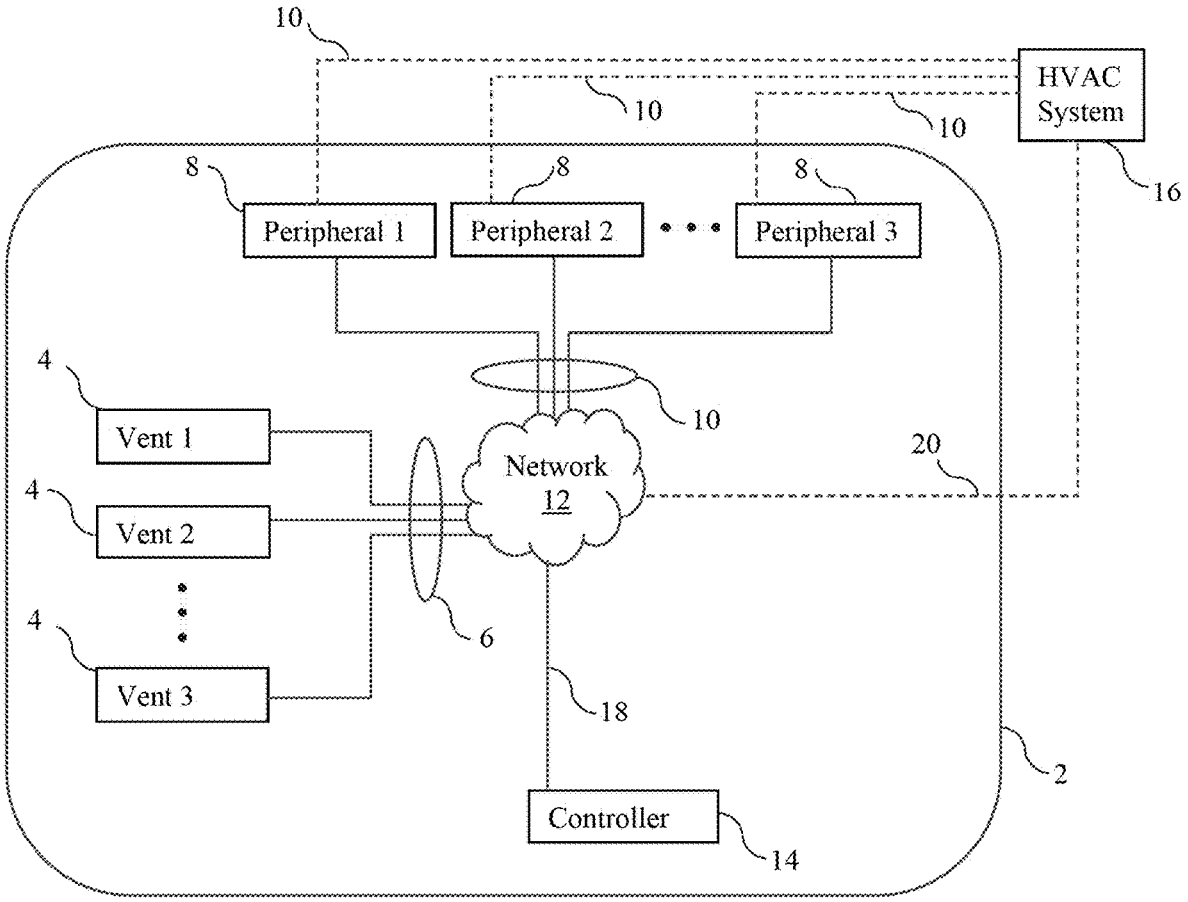
FIG. 1 is a block diagram of an example embodiment of a distributed zone control system.

Now, with reference to FIG. 1, a block diagram of a distributed zone control system 2 is provided. A distributed zone control system may comprise at least one vent 4, vent communication channel 6, peripheral 8 (alternatively, peripheral device 8), peripheral communication channel 10, network 12, controller 14, controller communication channel 18, and HVAC system communication channel 20. The distributed zone control system 2 may be in electronic communication with an HVAC system 16. For example, the distributed zone control system 2 may be connected via an HVAC system communication channel 20 to an HVAC system 16 to receive data from sensors of the HVAC system 16 and provide instructions to effectors of the HVAC system 16. The HVAC system 16 may include a heating, ventilating, or air conditioning system, or any other environmental management system, or any combination thereof configured to adjust aspects of an environment such as a building or home. For example, an HVAC system 16 may comprise an air conditioning system, a heating system, a humidifier system, a dehumidifier system, or any combination thereof.

A distributed zone control system 2 may comprise a vent 4. For example, in some embodiments the vent 4 may be an HVAC vent mounted to a ceiling, floor, or wall of a room to communicate conditioned air into a room. The conditioned air may be warmed, cooled, humidified, dehumidified, and/or the like by other systems (such as the HVAC system 16) and communicated into the room by the vent 4. In other embodiments, the vent 4 may be a vehicle dash vent, or may be a recreational vehicle vent, or may be a vent for regulating environmental characteristics of an industrial process, or any other vent as desired. The vent 4 may have a mechanical design encompassing advantageous aerodynamic features. Such features may reduce the noise caused by the airflow passing through the vent 4, e.g., when the airflow is forced by the fan, compressor, or other peripheral 8 to pass through the vent 4. The vent 4 may be integrated into a duct to receive the conditioned air or may be selectably connectable thereto. In various embodiments, the vent 4 is separately provided for a homeowner to purchase and install, such as an aftermarket home automation product. Thus, one will appreciate that the vent 4 may be any structure configured to communicate conditioned air to an area. As used herein, an area receiving conditioned air from a vent 4 may be termed a "zone." A zone may be associated with one vent 4, two vents 4, or any number of vents 4. As will be discussed later herein, a vent 4 may have one or more sensor or actuator (e.g., effector).

A distributed zone control system 2 may comprise a vent communication channel 6. A vent communication channel 6 may comprise any electronic mechanism for data communication and/or power communication between a sensor or actuator (e.g., effector) on a vent and other systems or devices. In various embodiments, the vent communication channel 6 may comprise a wired connection, wireless connection, or any other connection as desired. For example, the vent communication channel 6 may comprise power over Ethernet (POE) wiring to supply power to the components of the distributed zone control system 2. In various embodiments, the vent communication channel 6 comprises an aspect of the network 12 which will be discussed later herein, though in further embodiments, the vent communication channel 6 is separate. Moreover, the vent communication channel 6 may include mechanical features or other mechanisms. For instance, the vent communication channel 6 may comprise a tube configured to conduct substances for release from the vent 4. For example, the vent communication channel 6 may comprise a tube configured to conduct aromas from an aroma reservoir to the vent 4 for release therefrom. In various embodiments, the vent communication channel 6 may be wired. For example, consistent with recent code updates, the vent communication channel 6 may be low voltage cable running along an HVAC duct. In further embodiments, the vent communication channel 6 may be wiring inside an HVAC duct.

A distributed zone control system 2 may comprise a peripheral 8 (alternatively, a peripheral device 8). For example, in some embodiments the peripheral 8 may be an air handler (alternatively, an air-handling unit), a water heater, an ignitor, a humidifier, a dehumidifier, another vent 4, an aroma diffuser, and/or a stand-alone sensor of any type described herein or otherwise. These components are further described below.

A distributed zone control system 2 may comprise a peripheral communication channel 10. A peripheral communication channel 10 may comprise any electronic mechanism for data communication and/or power communication between a sensor or actuator (e.g., effector) on the peripheral 8 and other systems or devices. For example, in various embodiments the peripheral communication channel 10 may comprise a wireless connection, a wired connection, or any other connection as desired. In various embodiments, the peripheral communication channel 10 comprises an aspect of the network 12 which will be discussed later herein, though in further embodiments, the peripheral communication channel 10 is separate. Moreover, the peripheral communication channel 10 may include mechanical or other mechanisms. For instance, the peripheral communication channel 10 may comprise a tube configured to conduct substances (e.g., aroma) for release from the peripheral 8. In various embodiments, the peripheral communication channel 10 may be wired. For example, consistent with recent code updates, the peripheral communication channel 10 may be low voltage cable running along an HVAC duct. In further embodiments, the peripheral communication channel 10 may be wiring inside an HVAC duct.

A distributed zone control system 2 may comprise a network 12. The network may comprise any type of connection to communicate the signals between various components of the distributed zone control system 2, e.g., between vents 4 and peripherals 8. The network 12 may comprise any electronic mechanism for data communication and/or power communication between various components of distributed zone control system 2. In various embodiments, the network 12 may comprise, for example, a wireless connection, a wired connection, Internet, or any other connection as desired. In one exemplary embodiment, the sensors 44 (FIG. 4) associated with the vents 4 may communicate instructions to the peripherals 8 to actuate corresponding elements of the peripherals 8. For example, if the temperature is getting higher than a predetermined level, the sensor 44 associated with the vent 4 may instruct a peripheral 8 such as an air handler to supply cold air. Such instruction may be done via a controller 14, which is discussed later herein.

A distributed zone control system 2 may comprise an HVAC system communication channel 20. The HVAC system communication channel 20 may comprise any electronic mechanism for data communication or power communication between a sensor or actuator (e.g., effector) on the HVAC system and other systems or devices. For example, in various embodiments, the HVAC system communication channel 20 may comprise a wireless connection, a wired connection, such as traditional thermostat wiring, and/or power over Ethernet (POE) wiring to supply power to the components of the distributed zone control system 2, or any other connection as desired. In various embodiments, the HVAC system communication channel 20 comprises an aspect of the network 12 which will be discussed later herein, though in further embodiments, the HVAC system communication channel 20 is separate. The HVAC system communication channel 20 may be laid with or inside the ducting of the duct system. Such embodiment advantageously makes the connection of the physical components of the distributed zone control system 2 more efficient because the wiring can be integrated with the duct system. Also, the wiring may be done outside of the duct system, e.g., when providing some physical components of the distributed zone control system 2 selectively coupled to a wall, ceiling, floor, and/or inserted in wall outlets. Moreover, the peripheral communication channel 10 may include mechanical or other mechanisms. For example, one of such mechanisms may conduct aroma delivery, wherein the HVAC System Communication Channel 20 may comprise a tube configured to conduct substances (e.g., aroma) for release from the peripheral 8.

Figure 2:
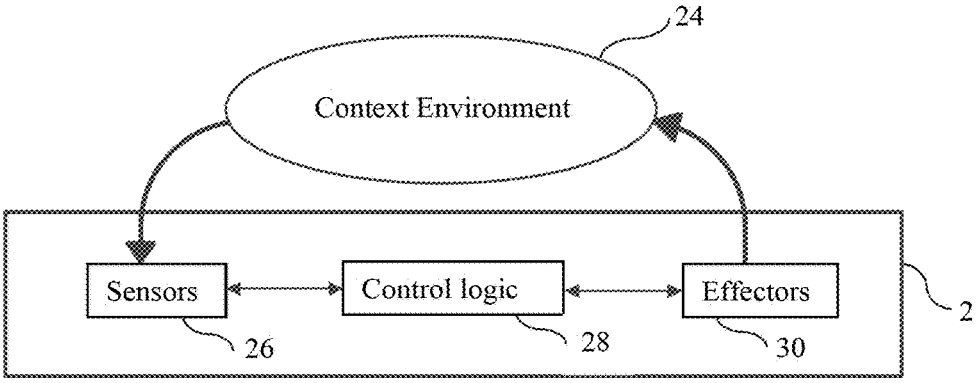
FIG. 2 is a block diagram of an example relationship of sensors and effectors in the distributed zone control system.

Before discussing aspects of the specific components of the distributed zone control system 2, attention is now directed to FIG. 2 to discuss one operative scenario of a distributed zone control system 2 and to provide context for further discussion. With reference to both FIGS. 1 and 2, and as mentioned, a distributed zone control system 2 may have both sensors 26 and effectors 30 within the distributed zone control system 2. The sensors 26 and effectors 30 may operate in interrelated ways. For example, the distributed zone control system 2 may have a control logic 28 which takes data from the sensors 26 and causes the effectors 30 to operate in response to that data. This operation causes changes in the environmental characteristics (e.g., temperature, humidity, etc.) of one or more zone. In various embodiments a zone may be a room of a house. The collection of zones operated upon by effectors 30 may be termed a context environment 24. Thus, one may conceptualize that in one non-limiting embodiment, a context environment 24 comprises a home, zones comprise rooms or areas of the home, and each zone is associated with at least one vent 4. One or more vents 4 may have sensors 26 on the vent and/or effectors 30 on the vent. Moreover, other sensors 26 and effectors 30 may be provided separately from the vents 4.

Figure 3:
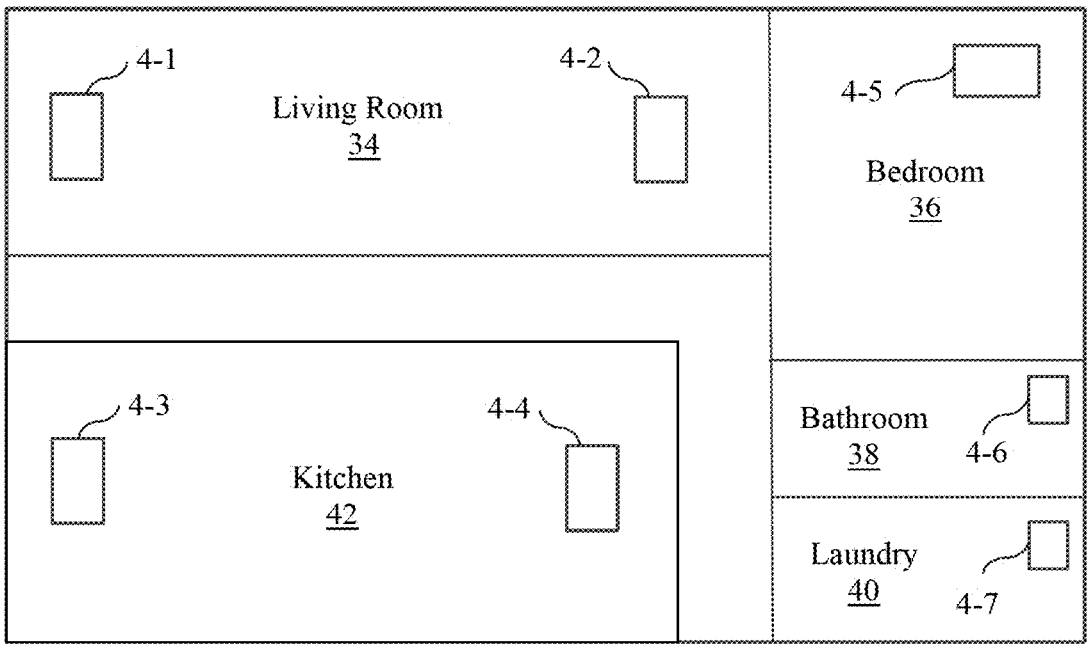
FIG. 3 is a diagram of an example home having the distributed zone control system.

Having introduced both the aspects of a distributed zone control system 2 and the sensor-effector relationship operative in some embodiments of the distributed zone control system 2, attention is now directed to FIG. 3 in addition to FIGS. 1-2 for an example installation of a distributed zone control system 2 in a context environment 24 comprising a home 32. The home 32 may have multiple rooms, such as a living room 34, a bedroom 36, a bathroom 38, a laundry room 40, and a kitchen 42. One may appreciate that some rooms have multiple vents, and some have single vents. For instance, a first vent 4-1 and a second vent 4-2 are associated with the living room 34. A third vent 4-3 and a fourth vent 4-4 are associated with a kitchen 42, a fifth vent 4-5 is associated with a bedroom 36, a sixth vent 4-6 is associated with a bathroom 38, and a seventh vent 4-7 is associated with a laundry room 40. Because some rooms have multiple associated vents 4, one may also appreciate that the sensors and effectors of multiple vents may interoperate. For example, if the effector of the second vent 4-2 is a gate that controls how much cold air enters the room, the position of this effector may change the temperature detected by a temperature sensor on the first vent 4-1. In this manner, and with renewed reference to FIG. 2, one may appreciate that the sensors 26 and effectors 30 may relate through control logic 28 in multi-causal, recursive, non-linear and other complex ways, including dynamic ways such as in response to various doors being left open or closed between rooms, or in response to different activities, such as cooking, showering, leaving exterior doors open, etc.

Figure 4:
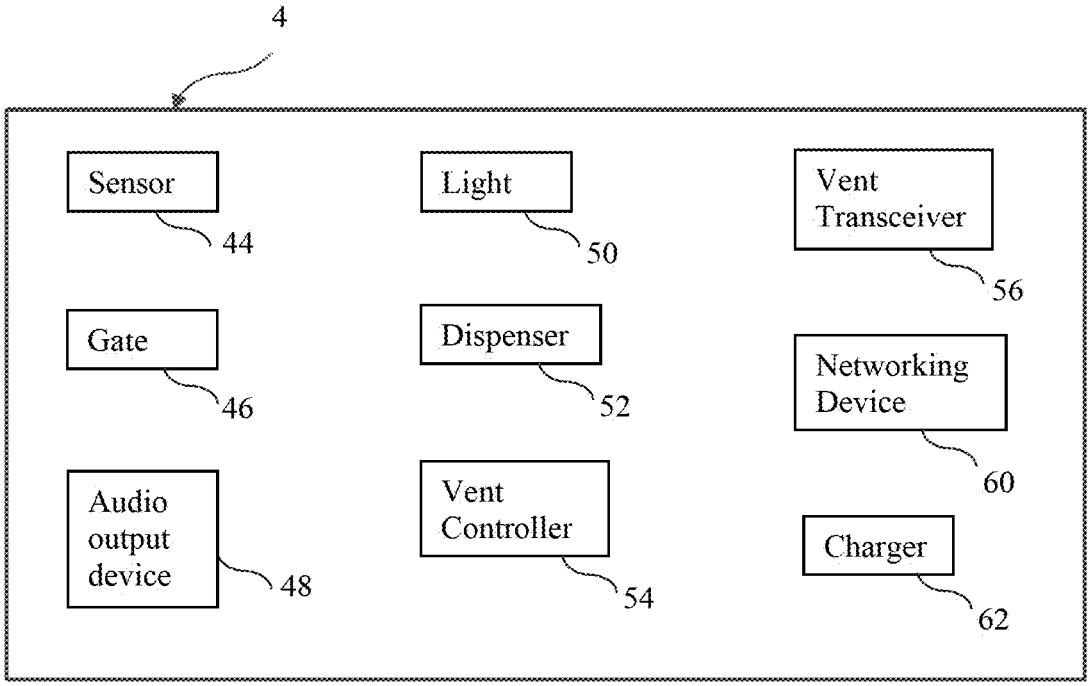
FIG. 4 is a block diagram of aspects of a vent of a distributed zone control system.

Having now generally introduced the distributed zone control system 2, the sensor-effector relationship operative in some embodiments of the distributed zone control system 2, and one example installation of a distributed zone control system 2 in an example context environment 24 comprising a home 32, attention is now directed to FIG. 4 for a discussion of specific aspects of some embodiments of a vent 4.

In various embodiments, a vent 4 may comprise a sensor 44. Such sensors 44 obtain various parameters depicting the conditions of the zones monitored by such sensors 44, for example, lighting, temperature, air quality, humidity, and occupancy. Also, sensors 44 may include, for example, sensors measuring a blower fan speed, AC fan relay power status, compressor contactor power status, furnace power status, settings of the humidifier and dehumidifier, water boiler status and temperature, main duct airflow, fresh air intake damper position, and/or position of duct dampers.

In various embodiments, a sensor 44 may comprise a light sensor that may obtain information about lighting conditions inside the zone where light sensor is located and it may, for example, further communicate such information to other devices comprising the distributed zone control system 2 and/or HVAC system 16.

In various embodiments, a sensor 44 may comprise a microphone. In such embodiment, the microphone may receive and send the signals to actuate other components of the distributed zone control system 2 and/or other smart home devices, such as TV, speakers, etc. The microphone may also comprise noise cancellation features to reduce the noise from the air circulating in the HVAC system 16 and/or the air that is flowing through the vents.

In various embodiments, a sensor 44 may comprise a temperature sensor that may measure the temperature inside a zone and, for example, further communicate such information to other devices comprising the distributed zone control system 2 and/or HVAC system 16. An exemplary embodiment of the temperature sensor may comprise a thermostat.

Another embodiment of a sensor 44 comprises an air quality sensor that may measure air quality. Such air quality sensors may include, for example, zone air sensors, duct air sensors, and security sensors. An exemplary embodiment comprises air quality sensors for measuring carbon monoxide, volatile organic compounds (VOCs), carbon dioxide, oxygen, and/or count of particles (e.g., PM2.5).

In various embodiments, a sensor 44 may comprise a pressure sensor that may measure a pressure of the air flow at various locations in the monitored zone and/or inside the duct system. For example, such pressure sensor may further communicate the received information to other devices comprising the distributed zone control system 2 and/or HVAC system 16.

In various embodiments, a sensor 44 may comprise a humidity sensor that may measure humidity of the monitored zone and communicate this information to other devices comprising the distributed zone control system 2 and/or HVAC system 16. An exemplary embodiment of the humidity sensor may comprise a humidistat.

In various embodiments, a sensor 44 may comprise an occupancy sensor that may measure occupancy and/or motion inside the monitored zone. The occupancy sensor may further communicate this information to other devices comprising the distributed zone control system 2 and/or HVAC system 16.

In various embodiments, a sensor 44 may comprise a camera for capturing, processing, and transmitting the footage of the monitored zone. The camera may further communicate this information to other devices comprising the distributed zone control system 2 and/or HVAC system 16.

In various embodiments, a sensor 44 may comprise the location sensors which may help build the floor plan. In this embodiment, a user of the distributed zone control system 2 may automatically assign in a user interface (discussed later herein) the location of the sensors associated with certain vents and consequently, the location of the certain vents. In further embodiments, this assignment may be manually performed.

In various embodiments, a vent 4 may comprise a gate 46. In this exemplary embodiment, the one or more vents 4 located in different zones may create the different settings for, e.g., the temperature, humidity, air flow pressure, and other conditions of the context environment 24. For example, the positions of effectors 30 on gates 46, which control how much cold air enters different zones, may change the temperature differently in the respective zones.

In various embodiments, a vent 4 may comprise an audio output device 48. In such embodiment, the audio output device 48 may be a speaker that transmits the audio signal to the user or other smart home devices. The volume of such audio signal may be controlled according to different settings in different zones.

In various embodiments, a vent 4 may comprise a light 50 that may illuminate a light into a zone. In some embodiments, the light 50 may be adjusted by the user to a different level of intensity, different color of illumination, etc. In some embodiments, such light may be an LED light.

In various embodiments, a vent 4 may comprise a dispenser 52. In such embodiment, the vent 4 is connected to the aroma system comprising an aroma diffuser, which further comprises an aroma reservoir and the aroma tubing disposed of the aroma reservoir. Optionally, the aroma diffuser may comprise an aroma controller. The vent 4 conducts the aroma to a zone where the vent 4 is installed.

In various embodiments, a vent 4 may comprise a vent controller 54. For example, the vent controller 54 may be a programmable device such as a circuitry connected to a motor actuating the position of the effector 30 controlling the vent 4. Thus, such position of the effector 30 depends on the data and/or commands received, analyzed, and sent by the vent controller 54.

In various embodiments, a vent 4 may comprise a vent transceiver 56. In such embodiments, the vent 4 receives and sends electrical and/or mechanical signals to actuate effectors 30 of other components of the distributed zone control system 2 or other devices located inside or in a relatively close proximity outside the home. In such embodiments, the vent 4 receives and sends electrical and/or mechanical signals to actuate sensors 44 of other components of the distributed zone control system 2 or other devices located inside or in a relatively close proximity outside the home.

In various embodiments, a vent 4 may comprise a networking device 60. In some embodiments, a networking device 60 associated with the vent 4 may serve as a networking hub for the distributed zone control system 2 and/or other devices located inside or in a relatively close proximity outside the home. The networking device may comprise a Wi-Fi access point or may comprise a Bluetooth, ZigBee, Z-Wave, or other type of access point. The vents 4 may be connected through various communication means to the sensors 44 located inside and outside the home. The devices of the distributed zone control system 2 may communicate between each other and externally through wired or wireless communication means. In an exemplary embodiment, the vent 4 may serve as the Wi-Fi access point device providing an improved coverage of the wireless network inside the home. In some embodiments, the communication is made utilizing mesh network which may be using low-energy radio waves. Some exemplary embodiments of communication means may include Z-Wave or ZigBee type of communication. For example, the networking device 60 may operate as a Z-Wave device. Also, the networking device 60 may operate as a ZigBee device.

In various embodiments, a vent 4 may comprise a charger 62. In such embodiments, the charger 62 associated with the vent 4 provides the power for itself and/or other components of a distributed zone control system 2 and/or other devices located inside or in a relatively close proximity outside the home. Some of the exemplary embodiments of the charger 62 may be a windmill and/or thermocouple device. For example, operation of the windmill may be based on the velocity of the wind of the air passing through the duct system, thus, generating electrical charge to power the internal and external devices (as to the distributed zone control system 2). The thermocouple device may be based on the principle of transforming the difference between high and low temperatures into an electrical charge powering the mentioned above devices.

Having fully discussed a vent, attention is directed to FIG. 1 for a discussion of a peripheral device 8 (alternatively, peripheral 8) of a distributed zone control system 2. In various embodiments, peripheral devices 8 may comprise an air handler (alternatively, an air-handling unit), a water heater, an ignitor, a humidifier, a dehumidifier, another vent 4, an aroma diffuser, a stand-alone sensor 44 of any other type described herein or otherwise.

In some embodiments, the air handler further comprises a blower, ducts for inflow and outflow of air, one or more filters, one or more chambers for air, one or more heating and/or cooling elements, one or more fans, and other air handler components to perform air handler functions in accordance with the present disclosure.

One exemplary embodiment of the water heater further comprises a tank for storing the heated water, a boiler, an ignitor, one or more heating elements, intake and exhaust pipes for water and air, one or more valves, safety switches, and other water heater components to perform water heating functions in accordance with the present disclosure. Alternatively, the water heater may be tankless; in such embodiment, the heated water is not stored in a tank but transferred to be used as needed. The water heater may be operated by different sources of energy, for example, the electric power, solar power, natural gas, propane, and/or geo-thermal power.

The ignitor may comprise a constant burner, hot surface ignitor, or a device generating an electric spark to initiate an operative condition of a burner that may be a component of the peripheral 8 and/or HVAC system 16.

The humidifier may comprise a humidistat, a drum and/or disc wheels, a pad, and/or a motor. In alternative embodiments, a bypass flow-through humidifier may be provided, which also comprises a direct connection of the water pipe to supply sprayed water on a hard surfaced pad to evaporate the water with a supplied hot air to further provide the resultant humidified air into a respective zone.

One embodiment of the dehumidifier, for example, may include a heat exchanger, fans, a condenser, one or more heating elements, and other dehumidifier components to perform dehumidifying functions in accordance with the present disclosure.

The aroma diffuser is a component of the aroma supply system to supply aroma scents to a zone. The aroma diffuser may comprise an aroma reservoir, intake and outflow tubing for supplying the condensed flavored substance and a solvent, e.g., water. Also, the aroma diffuser may comprise a controller that may control settings of the aroma diffuser (e.g., timing, intensity, flavor, etc.). A reservoir from where the aroma is distributed further into the peripheral communication channel 10 and/or vent communication channel 6 may be in at least one of the zones inside the home, e.g. in the kitchen or bathroom.

Vents 4 and sensors 44 are described in other parts of this disclosure.

A peripheral device 8 may be connected to other aspects of the distributed zone control system 2 via a peripheral communication channel 10. For example, a peripheral device 8 may be connected to a vent 4, to a controller 14, or it may be connected directly to the HVAC system 16. A peripheral communication channel 10 may comprise any electronic mechanism for data communication or power communication between a sensor or actuator (e.g., effector) on the peripheral 8 and other systems or devices. For example, in various embodiments the peripheral communication channel 10 may comprise a wireless connection, a wired connection, or any other connection as desired. In various embodiments, the peripheral communication channel 10 comprises an aspect of the network 12, though in further embodiments, the peripheral communication channel 10 is separate. Additionally, peripheral communication channel 10 may comprise the mechanical connection. For instance, the peripheral communication channel 10 may comprise a tube configured to conduct aromas from an aroma reservoir to the peripheral 8 for release therefrom. The peripheral communication channel 10 for such aroma delivery may be laid inside the ducts of the duct system. The peripheral communication channel 10 for such aroma delivery may be standalone tubes and/or adjustably coupled to the electrical wiring cables inside the duct system. In another embodiment, one or more of the electrical wiring cables may be located within the tubes for aroma delivery.

Finally, the distributed zone control system 2 may comprise a controller 14. The controller 14 may be any device configured to provide instructions based on the controller's 14 analysis of the received information from various devices disposed internally and externally in relation to the distributed zone control system 2. For example, in one embodiment, a controller 14 may be a general-purpose processor configured to perform such analysis and receipt of information as well as communicating the instructions. In other embodiments, a controller 14 may be a server (which, in turn, may be a cloud-based or a local server). The server may be located inside the duct system or in one of the zones, in an attic, or other location.

A controller 14 may be connected to other aspects of the distributed zone control system 2 via a controller communication channel 18. For example, a server associated with the controller 14 may be connected to the sensors 44 and all or some individual devices, such as the vents 4, the air handler, an ignitor, a water heater, a humidifier, and/or dehumidifier. A controller communication channel 18 may be wired or wireless. In one embodiment, a direct memory access controller (DMAC) connection may be utilized to provide an advantage of Wi-Fi connectivity. The server associated with the controller 14 may deliver processing power to some units of equipment, e.g., the vents 4 and/or some or all sensors 44. The server communicates with the various devices of distributed zone control system 2. For example, the server communicates with the sensors 44 (FIG. 4), i.e., the server receives the data and instructions from the sensors 44 (FIG. 4) and, after analyzing this and other information, the server may communicate actuation instructions to the vents 4, the air handler, and/or other devices and/or the user interface (discussed later herein). In one embodiment, the server may serve as a thermostat when, for example, the air handler is wired to the server, wherein a temperature sensor is located remotely from the server. In various embodiments, the controller may be a feature of a vent 4 and may be locally associated with one or more vent 4 being incorporated therein. In various embodiments, the controller is a distributed system of controllers associated locally with vents 4.

The controller 14 may be connected to the HVAC system 16. For example, the controller 14 may comprise an HVAC system communication channel 20 that interfaces with the HVAC system 16. In various embodiments, the HVAC system communication channel 20 may comprise traditional thermostat wiring that receives signals from the controller 14 to control operation of a legacy HVAC system 16. In this manner, automation may be added to older non-automated HVAC systems 16.

The controller 14 may perform diagnostic functions to monitor the status of the operability of components comprising the distributed zone control system 2, the HVAC system 16, and/or other devices inside or outside the home. Such embodiment provides advantageous asset management and preventive maintenance because the user may be alerted by the controller 14 if critical predetermined parameters of the physical components are reached. For example, degraded performance, the approaching expiration of life-limited components, anomalous behavior, and the like may be reported by the controller 14 to the user and/or others. Moreover, the required patches and updates to the software and firmware of the controller 14 may be done automatically without constant Wi-Fi connectivity. This advantageous embodiment improves the security of the distributed zone control system 2.

With additional reference to FIG. 4, the controller 14 may perform various emergency response actions. For instance, in response to loss of electrical power, the controller 14 may cause a gate 46 of a vent 4 to shut the vent 4 to limit power consumption of a HVAC system supplying conditioned air to the vent 4. Some vents 4 may be shut and others may remain open depending on the prioritization of conditioning different areas. Similarly, the controller 14 may, in response to detection by a sensor 44 of hazardous gas, automatically open and close gates 46 of vents 4, to direct gas flow in an area to move fresh air into the area, purging the hazardous gas.

Having recited various structural aspects of a distributed zone control system 2, attention is now directed to FIGS. 5-11 (with periodic reference also to FIGS. 1-4) for a discussion of various logical aspects and operative relationships among aspects of the distributed zone control system 2. While various aspects are depicted as logically distinct for ease of reference, one may appreciate that any portion of any logical aspect may be differently combined. Moreover, aspects of the depicted logical aspects in FIGS. 5-11 may operate on circuits, memories, processors, and/or the like of the vent 4, or of the peripheral 8, or of the network 12, or of the controller 14, or a remote system connected thereto via a network 12.

The logical aspects 500 of the distributed zone control system 2 include the following high-level systems: zone management system (ZMS) 502, equipment management system (EMS) 504, home information and management system (HIMS) 506, and user interface (UI) 508. These high-level representations depict systems and processes that may be distributed among the different devices in various ways.

The systems included in ZMS 502, EMS 504, HIMS 506, and UI 508 are provided. The arrows represent a communication of the status, commands, settings, desired conditions, configurations, and other information.

Figure 5:
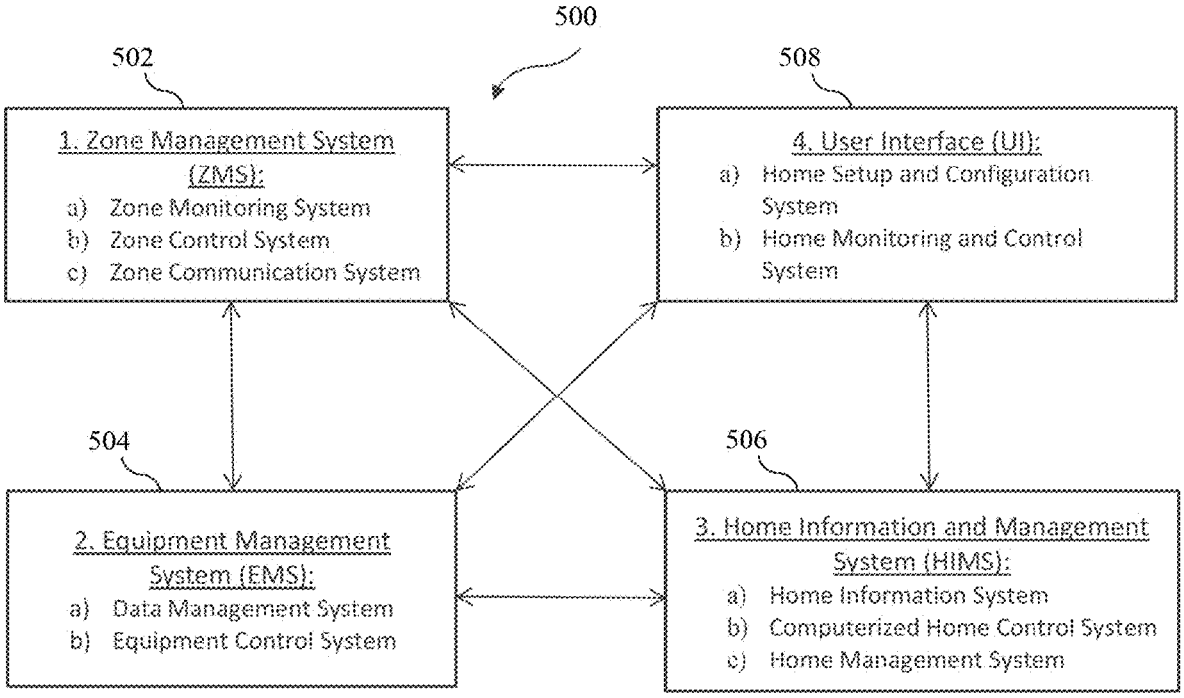
FIGS. 5-11 are diagrams of example logical relationships among aspects of a distributed zone control system facilitating the execution of operative control of the same, and more specifically.

Also, FIG. 5 represents one example embodiment of the operation of the ZMS 502, EMS 504, HIMS 506, and UI 508. In various embodiments, the ZMS 502, in general, may include the following: a zone monitoring system, a zone control system, and a zone communication system. The EMS 504 may generally include a data management system and an equipment control system. In various embodiments, the HIMS 506, in general, may include the following: a home information system, a computerized zone management system, and a home management system. The UI 508 may generally include: a home setup and configuration system as well as a home monitoring and control system.

Figure 6:
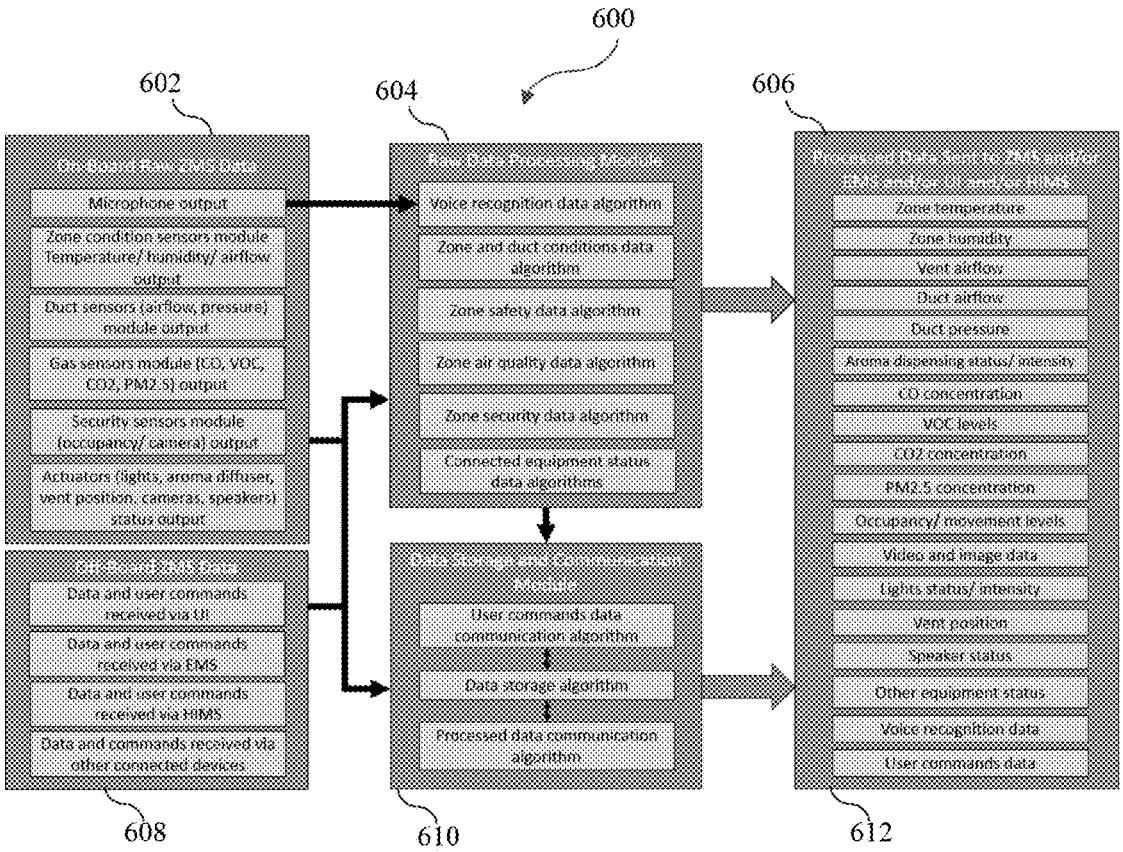

FIG. 6 represents one example embodiment of the operation 600 of the zone monitoring system. In various embodiments, a zone monitoring system may automatically read zone conditions (temperature, humidity, airflow), air duct conditions (temperature, humidity, airflow), zone gas levels (carbon monoxide, VOCs, carbon dioxide, and oxygen), zone particles count (PM2.5), zone activity (occupancy and motion), zone image and video data (for example, obtained from the camera), touchless voice instructions initiated by a user. The ZMS may communicate a status in real-time or historical data strings to the UI, HIMS, and/or EMS. For example, a change of a status real time data string may indicate a change in the zone temperature or humidity, or a change in the airflow (zone airflow or duct airflow), or an increase in toxic gas levels (carbon monoxide, VOCs), or a decrease in Indoor Air Quality (increase in PM2.5 count, or increase in CO2 levels, or decrease in oxygen levels), or occurrence of a security event (detection of motion or zone occupancy), or recognition of a voice instruction, a date/time of the increase, decrease, occurrence, and/or recognition of one or more of these variables. On-Board Raw ZMS data 602 may include various aspects such as microphone output, zone condition sensors output, duct sensor output, gas sensor output, security sensor output, and actuator output. The onboard raw ZMS data 602 may be communicated to a raw data processing module 604 and/or a data storage and communication module 610 as illustrated. Also, Off-Board ZMS Data 608 may be communicated to a raw data processing module 604 and/or a data storage and communication module 610. The raw data processing module 604 may also communicate with the data storage and communication module 610. The data storage and communication module may include various algorithms such as a user commands data communication algorithm, a data storage algorithm, a processed data communication algorithm, and the like. The raw data processing module 604 may also include algorithms such as a voice recognition data algorithm, a duct and zone condition data algorithm, a zone safety data algorithm, a zone air quality data algorithm, a zone security data algorithm, and a connected equipment status data algorithm. The raw data processing module 604 and the data storage and communication module 610 may communicate with a module 606 comprising processed data sent to ZMS and/or EMS and/or UI and/or HIMS. This processed data may be many different things. For instance, the processed data may be zone temperature, zone humidity, vent airflow, duct airflow, duct pressure, aroma dispensing status or intensity, CO concentration, VOC levels, CO2 concentration, PM2.5 concentration occupancy/movement levels, video or image data, light status/intensity, vent position, speaker status, other equipment status, voice recognition data, and user commands data.

Figure 7:
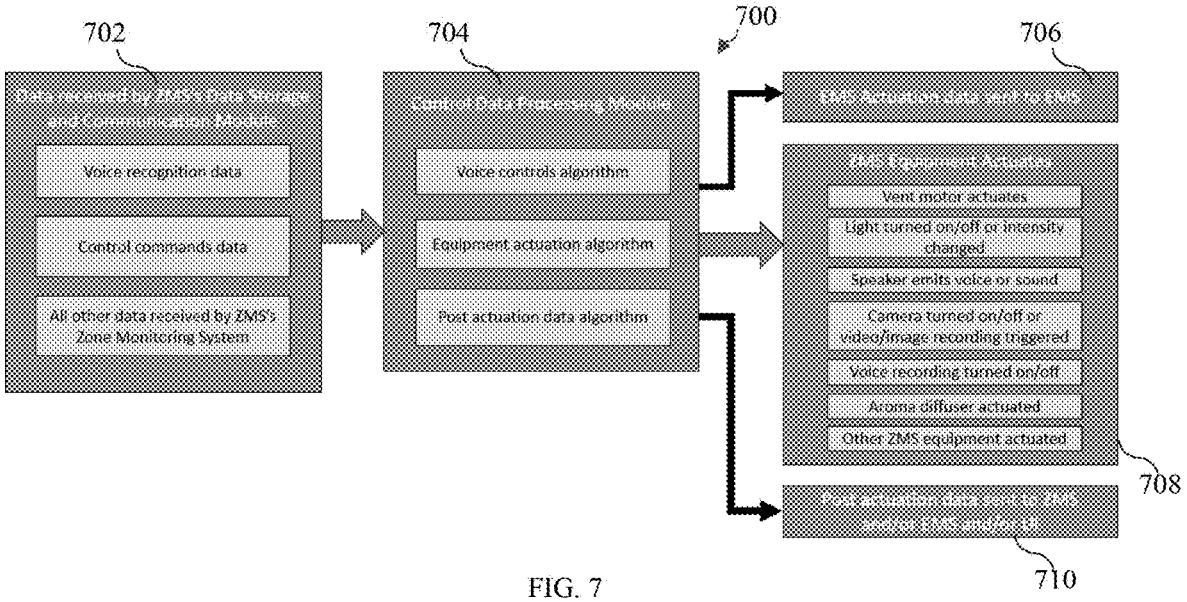

FIG. 7 represents one example embodiment of the operation 700 of the zone control system. In various embodiments, a zone control system may allow users to communicate voice instructions (e.g., without pressing a button) in the working vicinity of a ZMS device which are then processed to trigger the system to wirelessly and/or automatically perform smart home functions such as setting the zone to a desired temperature, or switching air vents on or off, and/or controlling other home equipment connected to the ZMS or EMS (for example, AC compressors, condenser coils, blower fans, variable speed fan controllers, water heaters, air intake systems, humidifiers, home appliances, lights, TVs, and audio output devices). Data 702 received by ZMS's data storage and communication module may include voice recognition data, control commands data, and/or all other data received by the ZMS zone monitoring system. This data 702 may be communicated to a control data processing module 704 including voice control algorithms, equipment actuation algorithms, and/or post-actuation data algorithms. The control data processing module 704 may communicate EMS actuation data 706 sent to an EMS. The control data processing module 704 may cause various actuations 708 of ZMS equipment, such as actuating vent motors, turning on or off lights or changing light intensity, causing a speaker to emit voice or sound, causing a camera to turn on or off and/or a video or image recording triggered, turning on or off voice recording, actuating an aroma diffuser, or actuating other ZMS equipment. The module 704 may send post actuation data 710 to ZMS and/or EMS and/or UI.

Figure 8:
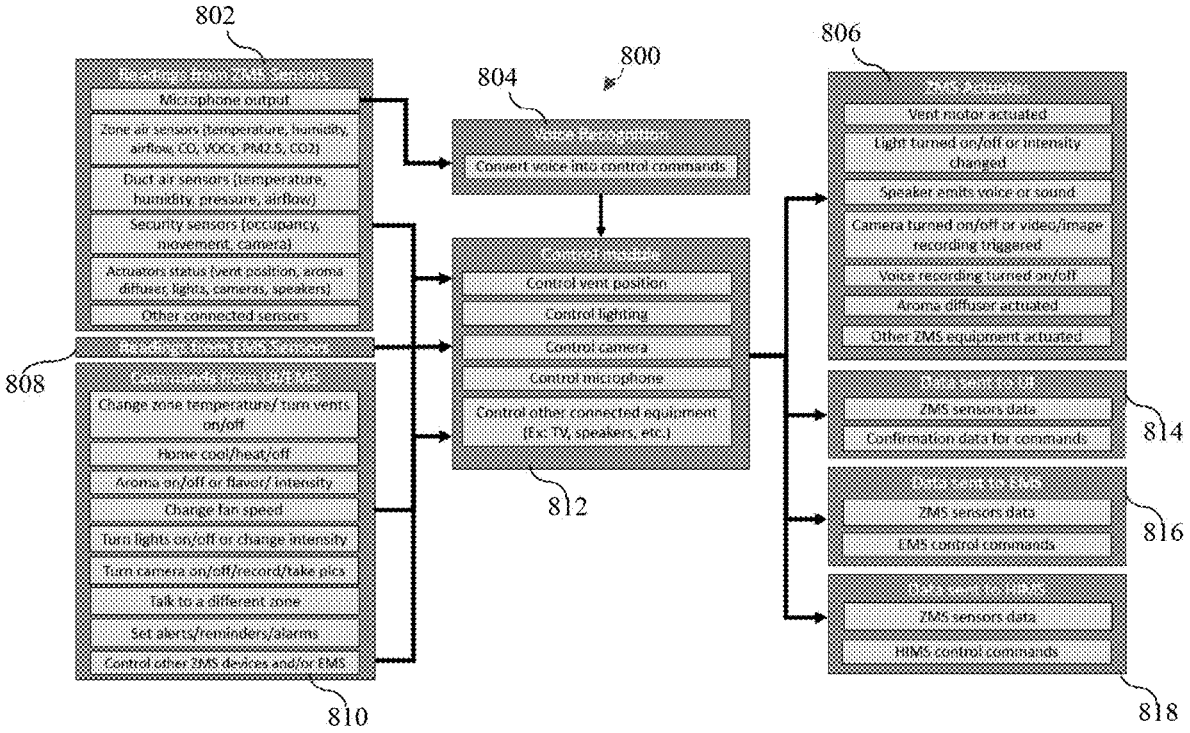

FIG. 8 represents one example embodiment 800 of the operation of the zone communication system. In various embodiments, a zone communication system may transmit a voice, sound, and/or light output through the ZMS device to alert occupants of critical events identified by the ZMS and/or pre-configured by the user (for example, detection of toxic gases, fire, motion, or a security breach, a notable change in air quality, and/or preset time alarms and reminders), or to acknowledge receipt of a voice instruction, or to confirm that the desired conditions received via the voice instruction and/or UIs have been reached. For instance, readings 802 from ZMS sensors may be provided to a control module 812 and/or a voice recognition system 804. The readings 802 may include a microphone output, zone air sensors output, duct air sensors output, security sensors, actuator status, and/or other connected sensors. Readings 808 from EMS sensors may also be provided to the control module 812. Commands 810 from a UI or EMS may be provided to the control module 812. The commands may be to change zone temperature, turn vents on or off, set an HVAC system to cool, heat, or off, turn an aroma on or off or change flavor or intensity, change a fan speed, turn lights on or off or change an intensity, turn a camera on or off, record, or take photos, allow communication to another zone, set alerts, reminders, and/or alarms, and/or control other ZMS devices and/or EMS. The voice recognition system 804 may convert voice into control commands which also feed the control module 812. The control module may control various aspects. For instance, the control module may control a vent position, control lighting, control a camera, control a microphone, and/or control other connected equipment such as a TV, speakers, etc. The control module 812 may cause the ZMS to undertake various actuations 806. For example, the vent motor may actuate, a light may be turned on or off or an intensity changed, a speaker may emit voice or sound, a camera may turn on or off or a video or image recording may be triggered, a voice recording may turn on or off, an aroma diffuser may be actuated, and other ZMS equipment may be actuated. The control module 812 may send data 814 to a UI. For instance, the control module 812 may send ZMS sensors data, and or confirmation data for commands. The control module 812 may send data 816 to an EMS. The data may include ZMS sensors data, EMS control commands, and the like. The control module 812 may send data 818 to the HIMS. The data 818 may include ZMS sensors data and HIMS control commands.

Figure 9:
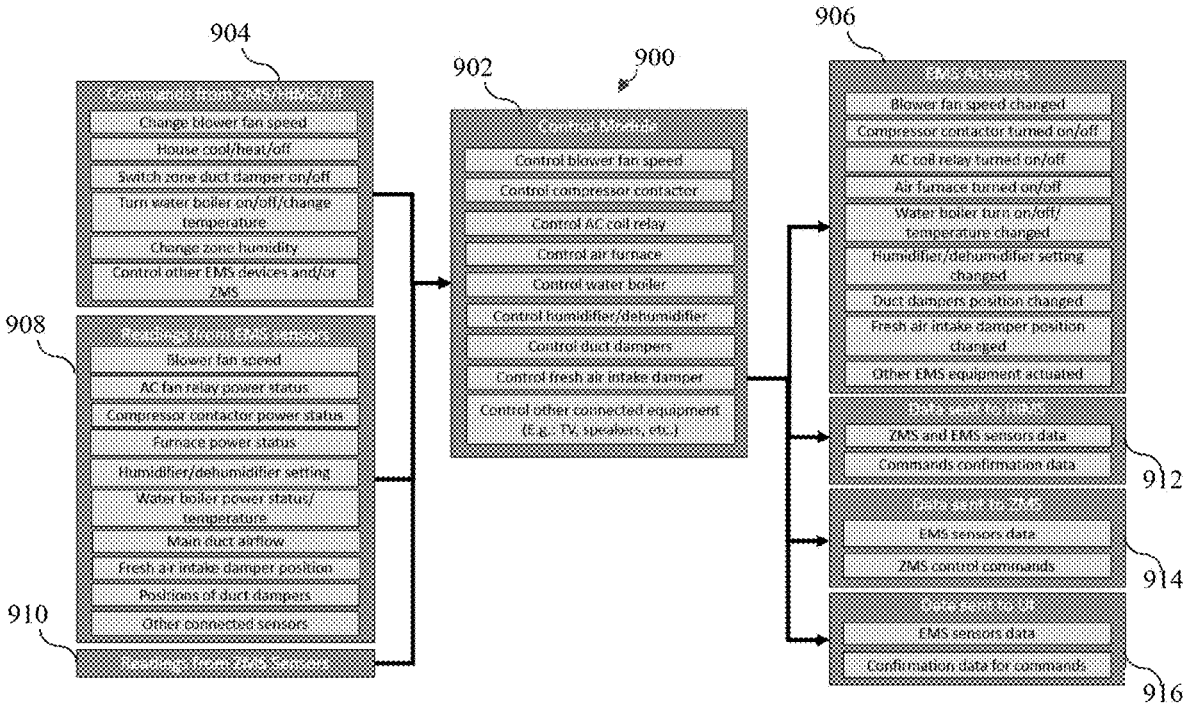

FIG. 9 represents one example embodiment 900 of the operation of the EMS. In various embodiments, the EMS may generally include a data management system and an equipment control system (as shown on FIG. 5).

In various embodiments, a data management system may collect real-time and historical data and information from the ZMS, the HIMS, at least one user interface (UI), and/or other home devices connected to the distributed zone control system 2 or the HVAC system 16, process the data, and provide data and information to the HIMS, and/or at least one UI, and/or ZMS.

In various embodiments, an equipment control system may generate control commands, actuate home equipment such as the vent motor controller, vent speakers, vent lights, variable speed air blower, air-handler (alternatively, air handling unit), duct dampers, and other connected actuators (for instance, relays and contactors connected to the condenser coil, AC compressor, air blower, air furnace, water boiler, and fresh air intake system), and may send data and information to the controllers of any home appliances connected to the HIMS. For example, commands 904 from a ZMS, HIMS, and/or UI may include changing a blower fan speed, setting an HVAC system to cool, heat, and/or off, switching a zone duct damper between on and off, turning a water boiler on or off or changing temperature, changing a zone humidity, and/or controlling other EMS devices and/or ZMS. The commands 904 may be provided to a control module 902.

The system 900 may include readings 908 from EMS sensors. The readings may be provided to the control module 902. The readings may include a blower fan speed, AC fan relay power status, compressor contactor power status, furnace power status, humidifier and/or dehumidifier setting, water boiler power status and/or temperature, main duct airflow, fresh air intake, duct damper positions, and/or other connected sensors readings. The system may include readings 910 from ZMS sensors. The readings 910 may be provided to the control module 902.

The control module 902 may control various things. For instance, the control module may control a blower fan speed, a compressor contactor, an AC coil relay, an air furnace, a water boiler, a humidifier and/or dehumidifier, duct dampers, a fresh air intake damper, and/or other connected equipment such as TV, speakers, etc. The control module 902 may cause various EMS actuation 906 actions. For instance, EMS actuation 906 actions may include a blower fam speed change, a compressor contactor turning on or off, an AC coil relay turning on or off an air furnace turning on or off, a water boiler turning on or off or temperature changed, a humidifier or dehumidifier setting change, a duct damper position change, a fresh air intake damper position changed, and/or other EMS equipment actuated. The control module 902 may cause data 912 to be sent to HIMS. The data may include ZMS or EMS sensors data, and/or commands confirmation data. The control module 902 may cause data 914 to be sent to ZMS. The data 914 may include EMS sensors data and/or ZMS control commands. The control module 902 may cause data 916 to be sent to a UI. The data 916 may include EMS sensors data and/or confirmation data for commands.

Figure 10:
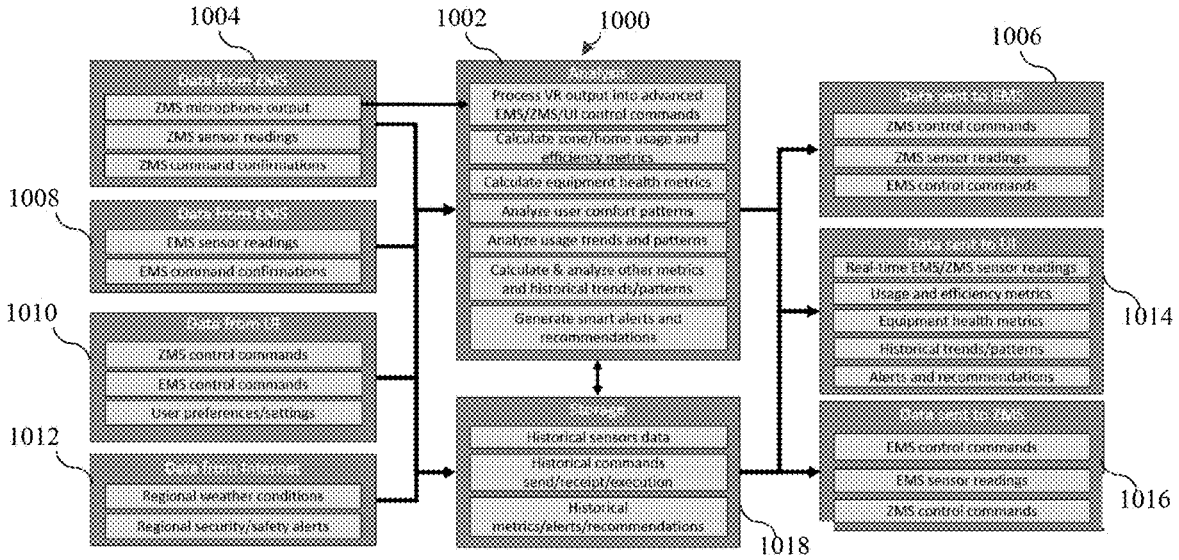

FIG. 10 represents one example embodiment 1000 of the operation of the HIMS. In various embodiments, the HIMS, in general, may include the following: a home information system, a computerized zone management system, and a home management system (as shown on FIG. 5).

In various embodiments, a home information system (alternatively, a zone and duct information system) may store real time data and information/data strings received from the ZMS and/or the EMS, and/or at least one UI into a database and may provide historical data and information to users using user interfaces (UIs).

In various embodiments, a computerized zone management system (alternatively, a computerized home control system) may send control commands to the EMS. In various embodiments, a home management system (alternatively, a zone management system) may provide insights and/or recommendations to the user via UIs.

Data 1004 from the ZMS may include ZMS microphone outputs, ZMS sensor readings, and ZMS command confirmations. This data may be provided to an analysis module 1002 and/or a storage module 1018. Data 1008 from an EMS may include EMS sensor readings and EMS command confirmations. This data may be provided to an analysis module 1002 and/or a storage module 1018. Data 1010 from the UI may include ZMS control commands, EMS control commands, and/or user preferences/settings. This data 1010 may be provided to the analysis module 1002 and/or the storage module 1018. Data 1012 from the internet may include regional weather conditions and/or regional security/safety alerts. The data 1012 from the internet may be provided to an analysis module 1002 and/or a storage module 1018.

The analysis module 1002 may conduct various analyses. For instance, the analysis module 1002 may process VR output into advanced EMS/ZMS/UI control commands. The analysis module 1002 may calculate zone and/or home usage and efficiency metrics. The analysis module 1002 may calculate equipment health metrics. The analysis module 1002 may analyze user comfort patterns. The analysis module 1002 may analyze usage trends and patterns. The analysis module 1002 may calculate and analyze other metrics and historical trends and/or patterns. The analysis module 1002 may generate smart alerts and recommendations.

The storage module 1018 may store historical sensors data. The storage module 1018 may store historical commands send/receipt/execution. The storage module 1018 may store historical metrics, alerts, and/or recommendations. The storage module 1018 may be in communication with the analysis module 1002.

The analysis module 1002 may be in communication with other aspects and may provide data 1006 sent to the EMS, data 1014 sent to the UI, and/or data 1016 sent to the ZMS. The storage module 1018 may be in communication with other aspects and may provide data 1006 sent to the EMS, data 1014 sent to the UI, and/or data 1016 sent to the ZMS.

The data 1006 sent to the EMS may include ZMS control commands, ZMS sensor readings, and/or EMS control commands. The data 1014 sent to the UI may include real-time EMS/ZMS sensor readings, usage and efficiency metrics, equipment health metrics, historical trends/patterns, and/or alerts and recommendations.

The data 1016 sent to the ZMS may include EMS control commands, EMS sensor readings, and/or ZMS control commands.

Figure 11:
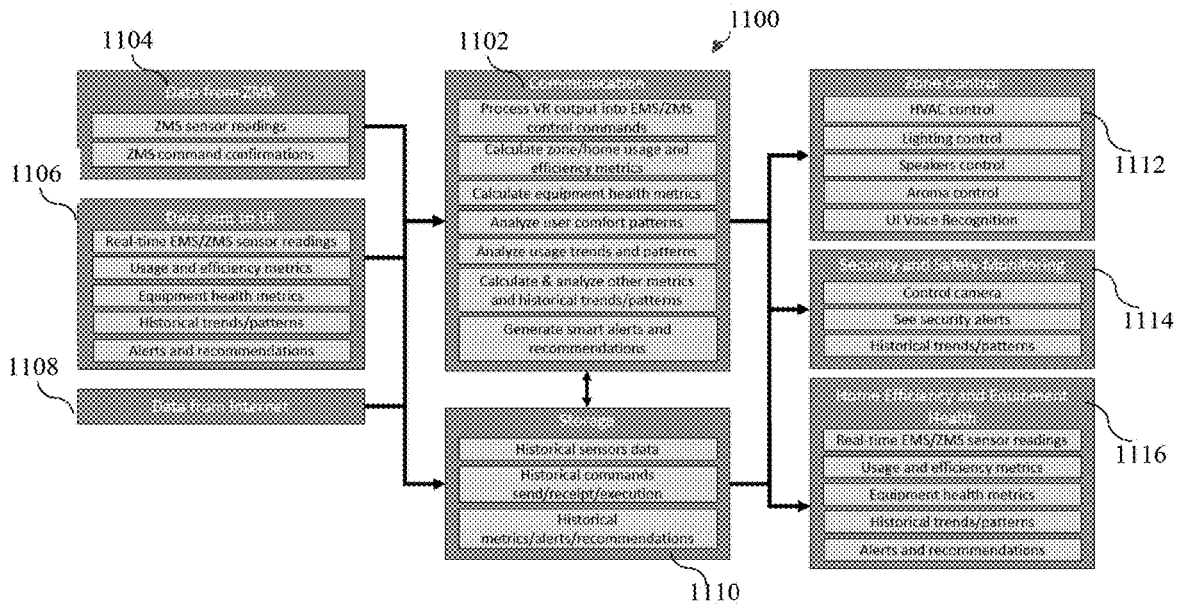

FIG. 11 represents one example embodiment of the operation 1100 of the UI. The UI may generally include: a home setup and configuration system as well as a home monitoring and control system (as shown on FIG. 5).

In various embodiments, UI is a computerized software application that displays real-time and historical information for the user as well as alerts, recommendations and insights. The UI is also used to input desired parameters for monitored zones and/or control other devices. The example embodiment of the operation 1100 of the UI may include various aspects. For instance, data 1104 from a ZMS may be included. The data 1104 may include ZMS sensor readings and/or ZMS command confirmations. The example embodiment of the operation 1100 of the UI may include data 1106 sent to a UI. The data 1106 may include real-time EMS/ZMS sensor readings, usage and efficiency metrics, equipment health metrics, historical trends/patterns, and/or alerts and recommendations. The operation 1100 of the UI may also include data 1108 from the internet. The data 1104 from the ZMS may be provided to a communication module 1102 and/or a storage module 1110. The data 1106 sent to the UI may be provided to the communication module 1102 and/or storage module 1110. The data 1108 from the internet may be provided to the communication module 1102 and/or the storage module 1110. The communication module 1102 and the storage module 1110 may be in communication.

The communication module 1102 may perform various communication actions. These actions may include actions to process VR output into EMS/ZMS control commands, calculate zone/home usage and efficiency metrics, calculate equipment heath metrics, analyzing user comfort patterns, analyze usage trends and patterns, calculate and analyze other metrics and historical trends/patterns, and/or generate smart alerts and recommendations.

The storage module 1110 may perform various storage actions. The storage module 1110 may store historical sensors data, historical commands send/receipt/execution data, and/or historical metrics/alerts and/or recommendations.

The communication module 1102 and/or the storage module 1110 may be communication with a zone control module 1112. The zone control module 1112 may control various aspects. For instance, the zone control module 112 may effectuate HVAC control, lighting control, speaker control, aroma control, and/or UI voice recognition.

The communication module 1102 and/or the storage module 1110 may be communication with a security and safety monitoring module 1114. The security and safety monitoring module 1114 may include actions to control a camera, see security alerts, and/or show historical trends/patterns.

The communication module 1102 and/or the storage module 1110 may be in communication with a home efficiency and equipment health module 1116. The home efficiency and equipment health module 1116 may include aspects such as real-time EMS/ZMS sensor readings, usage and efficiency metrics, equipment health metrics, historical trends/patterns, and/or alerts and recommendations.

With reference to all of FIGS. 1-11, one may appreciate that the structures of FIGS. 5-11 may be instantiated by operative software and/or circuits of distributed zone control system 2, such as the vents 4, peripherals 8, controller 14, and/or network 12. One may further appreciate that some aspects of the structures of FIGS. 5-11 which are depicted as separate elements for convenience, may be arranged differently and/or combined.

Having addressed various aspects, embodiments, and configurations of systems, attention is now directed to the collection of FIGS. 1-11, for a discussion of some non-limiting embodiments of the features. For instance. a distributed zone control system 2 may have one or more vents 3. Such vents 4 may include a sensor and an effector. Also, one or more peripheral device 8 may be provided. Such components of the distributed zone control system may communicate via a vent communication channel 6 and/or a peripheral communication channel 10. These components may be connected to a network 12, which may further comprise a controller 14. Also, the network may include a controller communication channel 18, and/or HVAC system communication channel 20.

A distributed zone control system 2 is for optimizing zone conditions. The system may include at least one vent 4, further including a sensor and an effector. The system may include a controller 14 configured to receive data from the sensor and instruct an actuation of the effector in response to the data.

In various embodiments, the sensor 44 is a temperature sensor. The effector may be a gate 46 configured to regulate airflow through the vent 4. The data may correspond to a detected temperature being below a first threshold. The controller may close the gate 46 to decrease airflow through the vent in response to the detected temperature being below the first threshold.

The sensor 44 may be various types of sensors. For instance, the sensor may be at least one of a temperature sensor, a duct pressure sensor, a gas detection sensor, and an occupancy sensor. The effector may be a gate 46 configured to regulate airflow through the vent 4. The data may correspond to the sensor 44 detecting an event associated with a sensed variable sensed by the sensor 44 being outside a desired range. The controller may close the gate 46 to decrease airflow through the vent in response to the sensed variable sensed by the sensor being outside the desired range.

In various embodiments, the sensor 44 is a temperature sensor. The effector may be a gate 46 configured to regulate airflow through the vent 4. The data may correspond to a detected temperature being above a first threshold. In various embodiments, the controller closes the gate 46 to decrease airflow through the vent in response to the detected temperature being above the first threshold.

The sensor 44 may be a temperature sensor. The effector may be a gate 46 configured to regulate airflow through the vent 4. The data may correspond to a detected temperature. The controller may actuate the gate 46 in a first direction to decrease airflow through the vent 4 in response to the detected temperature being outside the first threshold. The controller may actuate the gate 46 in a second direction to increase airflow through the vent in response to the detected temperature being outside a second threshold.

In various embodiments, outside the first threshold includes the detected temperature being less than a first threshold temperature and outside the second threshold includes the detected temperature being greater than a second threshold temperature. The second threshold temperature may be greater than the first threshold temperature.

In various embodiments, the sensor 44 is a periodic timer and the effector is an aroma dispenser 52. In various embodiments, the actuation of the effector includes to release an aromatic substance into the vent 4 for distribution in a room by an air source connected to the vent 4 at a periodic time indicated by the periodic timer. The at least one vent 4 may include a first vent having the sensor and the effector and a second vent having a second effector. The controller may be configured to receive data from the sensor and instruct a further actuation of the second effector in response to the data. In various embodiments, the sensor and the effector are both connected to the controller, and the at least one vent includes a first vent having the sensor and the effector and a second vent having a second effector. The controller may be configured to receive data from the sensor and instruct a further actuation of the second effector in response to the data.

In various embodiments, the distributed zone control system for optimizing zone conditions is an HVAC control system for maintaining a desired temperature in multiple zones. The zones may be rooms. The vents may be HVAC duct outlet vents of an HVAC system. The vents may be connected to the controller via cabling that runs adjacent to ducts of the HVAC system. The controller may be integrated into a thermostat of the HVAC system. The vents may be connected to the controller via cabling that runs inside of ducts of the HVAC system.

A distributed zone control system 2 is provided. The system may include a first HVAC vent connected to an HVAC cooling system and a second HVAC vent connected to the HVAC cooling system. The first HVAC vent may have a first sensor and a first effector. The second HVAC vent may have a second sensor and a second effector. There may be a controller connected to the first sensor, the first effector, the second sensor, and the second effector via a network.

In various embodiments, the network includes cabling running adjacent to ducts of the HVAC cooling system. The controller may be an HVAC thermostat. The controller may be a remotely disposed computer connected to the network via an internet connection. The controller may be a smartphone connected to a remotely disposed computer, and the remotely disposed computer may be a server connected to the network via an internet connection.

An HVAC vent 4 for connection to a distributed zone control system of an HVAC cooling system is provided. The HVAC vent 4 may include a vent 4 configured to conduct conditioned air from an HVAC duct to a context environment, a sensor 44 including a temperature sensor on the HVAC vent to detect a temperature of at least one of the conditioned air and the context environment, and an effector including a gate 46 on the HVAC vent 4 to regulate a volume of conditioned air conducted from the HVAC duct by the vent 4. The effector moves to permit a greater or lesser volume of conditioned air conducted from the HVAC duct by the vent 4 in response to an indication by the temperature sensor of the temperature being above or not above a desired set-point temperature, respectively. In various embodiments, the effector moves in response to an instruction from a controller attached to the HVAC vent and connected to the sensor.

The present disclosure has been described with reference to various embodiments. However, one of ordinary skill in the art appreciates that various modifications and changes can be made without departing from the scope of the present disclosure. For example, features of different embodiments may be combined. Accordingly, the specification is to be regarded in an illustrative rather than a restrictive sense, and all such modifications are intended to be included within the scope of the present disclosure.

For the sake of brevity, conventional techniques for manufacturing and construction may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical method of construction. As used herein, mechanical communication means any joint, connection, bond, or arrangement whereby an article is held, retained, or fixed in relatively static spatial relationship to another article. As used herein, electronic communication means any wired, wireless, analog, digital, or other mechanism whereby information is communicated between machines, circuits, or devices.

Benefits, other advantages, and solutions to problems have been described herein with regard to various embodiments. However, the benefits, advantages, solutions to problems, and any elements that may cause any benefit, advantage, or solution to occur or become more pronounced are not to be construed as critical, required, or essential features or elements of the invention. Moreover, where a phrase similar to "at least one of A, B, and C" or "at least one of A, B, or C" is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

As used herein, the singular forms "a," "an," and "the" include plural referents unless the context clearly dictates otherwise. As used herein, the terms "for example," "for instance," "such as," or "including" are meant to introduce examples that further clarify more general subject matter. Unless otherwise specified, these examples are embodiments of the present disclosure, and are not meant to be limiting in any fashion.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A distributed zone control system for optimizing zone conditions, comprising:

a plurality of vents, wherein each vent further comprises a sensor on the vent and an effector on the vent and a controller on the vent, wherein each vent of the plurality of vents is connected to a vent communication channel comprising wiring inside an HVAC duct; and the controller configured to receive data from the sensor on the vent and instruct an actuation of the effector in response to the data and further instruct an actuation of the effectors on every vent of the plurality of vents in response to the data received by the controller from the sensor on the vent, and wherein the effector comprises a fan providing an airflow gate to regulate a volume of conditioned air conducted from an HVAC duct by the vent.

2. The system of claim 1, wherein the sensor comprises a temperature sensor on the vent, wherein the effector comprises a gate on the vent and configured to regulate airflow through the vent, wherein the data corresponds to a detected temperature being below a first threshold, and wherein the controller closes the gate to decrease airflow through the vent in response to the detected temperature being below the first threshold.

3. The system of claim 1, wherein the sensor comprises a temperature sensor on the vent, wherein the effector comprises a gate on the vent and configured to regulate airflow through the vent, wherein the data corresponds to a detected temperature being above a first threshold, and wherein the controller closes the gate to decrease airflow through the vent in response to the detected temperature being above the first threshold.

4. The system of claim 1, wherein the sensor comprises a temperature sensor on the vent, wherein the effector comprises a gate on the vent and configured to regulate airflow through the vent, wherein the data corresponds to a detected temperature, and wherein the controller actuates the gate in a first direction to decrease airflow through the vent in response to the detected temperature being outside a first threshold, and wherein the controller actuates the gate in a second direction to increase airflow through the vent in response to the detected temperature being outside a second threshold.

5. The system of claim 4, wherein outside the first threshold includes the detected temperature being less than a first threshold temperature, wherein outside the second threshold includes the detected temperature being greater than a second threshold temperature, and wherein the second threshold temperature is greater than the first threshold temperature.

6. The system of claim 1, wherein the sensor comprises a periodic timer and the effector is an aroma dispenser, and wherein the actuation of the effector comprises releasing an aromatic substance into the vent for distribution in a room by an air source connected to the vent at a periodic time indicated by the periodic timer.

7. The system of claim 1, wherein the at least one vent comprises a first vent having the sensor on the first vent and the effector on the first vent and a second vent having a second effector on the second vent, and wherein the controller is configured to receive data from the sensor on the first vent and instruct a further actuation of the second effector on the second vent in response to the data.

8. The system of claim 7, wherein the sensor on the first vent and the effector on the first vent are both connected to the controller, and wherein the at least one vent comprises:

the first vent having the sensor on the first vent and the effector on the first vent; and a second vent having a second effector on the second vent, wherein the controller is configured to receive data from the sensor on the first vent and instruct a further actuation of the second effector on the second vent in response to the data.

9. The system of claim 1, wherein the distributed zone control system for optimizing zone conditions comprises an HVAC control system for maintaining a desired temperature in multiple zones comprising rooms.

10. The system of claim 9, wherein the vents comprise HVAC duct outlet vents of an HVAC system.

11. The system of claim 10, wherein the vents are connected to the controller via cabling that runs adjacent to ducts of the HVAC system.

12. The system of claim 1, wherein the sensor comprises at least one of a gas detection sensor, and an occupancy sensor, wherein the effector comprises a gate configured to regulate airflow through the vent, wherein the data corresponds to the sensor detecting an event associated with a sensed variable sensed by the sensor being outside a desired range, and wherein the controller closes the gate to decrease airflow through the vent in response to the sensed variable sensed by the sensor being outside the desired range.

13. The system of claim 10, wherein the vents are connected to the controller via cabling that runs inside of ducts of the HVAC system.

* * * * *